United States Patent [19]

Rutigliano

[11] Patent Number: 4,828,264

[45] Date of Patent: May 9, 1989

[54] HAND HELD GAME FOR PLAYING LIAR'S POKER

[76] Inventor: Joseph Rutigliano, 1949 Hunter Rd., Chino, Calif. 91710

[21] Appl. No.: 188,029

[22] Filed: Apr. 29, 1988

[51] Int. Cl.[4] ..... A63F 7/04

[52] U.S. Cl. ..... 273/138 R

[58] Field of Search ..... 273/86 C, 110, 113, 273/115, 138 R; 434/188

[56] References Cited

U.S. PATENT DOCUMENTS

| | | | |
|---|---|---|---|
| 271,530 | 1/1883 | Spang | 273/86 C UX |
| 797,105 | 8/1905 | Graves | 273/110 |
| 884,605 | 4/1908 | McEvoy | 273/110 |
| 1,879,511 | 9/1932 | Rodgers | 273/138 R |
| 4,340,228 | 7/1982 | Robbins et al. | 438/188 X |

*Primary Examiner*—Anton O. Oechsle

*Attorney, Agent, or Firm*—Edgar W. Averill, Jr.

[57] ABSTRACT

An improved hand held game for playing liar's poker. The game uses a plurality of small balls and a covered tray in which a number of chambers are contained. The improvement relates to the positioning of baffles to reduce the possibility that the results of the game can be skewed. When the game is tilted, the balls are retained by a pair of V-shaped baffles, and only when the game is relatively level will it operate thus providing a more even distribution of results.

10 Claims, 1 Drawing Sheet

HAND HELD GAME FOR PLAYING LIAR'S POKER

BACKGROUND OF THE INVENTION

The field of the invention is amusement devices and the invention relates more particularly to games which utilize a plurality of small balls which roll into various chambers.

The applicant has developed a hand held liar's poker game. Liar's poker is a game typically played with a group of people holding dollar bills or other paper currency. Bids are made in increasing numbers until no player will increase the bid. The person with the highest bid wins the game if the total of numbers which he has bid is equalled or exceeded by the total of the same number in the group. With the amusement device of the present invention, there is no need to use currency, and instead the numbers are created by the chance rolling of small metal balls into various chambers at the bottom of the game. The earlier device created by the applicant had the deficiency of being easily skewed by tilting the game and causing a larger number of balls to fall in the compartments in one side or the other of the game. Although the particular number is not determinative of a winner, it does tend to change the concept of the game, and a way of eliminating this tendency was sought.

SUMMARY OF THE INVENTION

An object of the present invention is to provide a hand held game which provides an improved distribution of balls within a plurality of chambers.

The present invention is for an improved hand held game for playing liar's poker of the type having a generally flat, hollow, elongated, rectangular tray with an upper end and a lower end. A transparent area is located at the lower end which exposes to view a plurality of elongated ball-retaining chambers, and the rest of the tray is covered with an opaque cover. The tray contains a plurality of small balls which fit within the ball-retaining chambers and when the game is tilted so that the balls roll toward the ball-retaining chambers, the number in each chamber is ascertainable by viewing the chambers. The improved game has a pair of large, generally sideways V-shaped baffles positioned near the upper end of the tray with the points of the baffles facing one another and the points being separated apart a sufficient distance to permit at least two, but not more than four balls, to pass between the points at one time. The V-shaped baffles are oriented so that the upper side of the V-shaped baffle causes the ball to pass between the points of the V-shaped baffle when the tray is tilted slightly toward the ball-retaining chambers. When the tray is tilted either to the right or the left, the balls are held above the V-shaped baffles thereby preventing the balls from rolling toward one edge or the other of the game. In a preferred configuration, a smaller pair of V-shaped baffles is located near the ball-retaining chambers and in a still further improvement, a second small pair of V-shaped baffles is located near the first small set but closer to the large V-shaped baffles.

DESCRIPTION OF THE PREFERRED EMBODIMENTS

Figure 1:
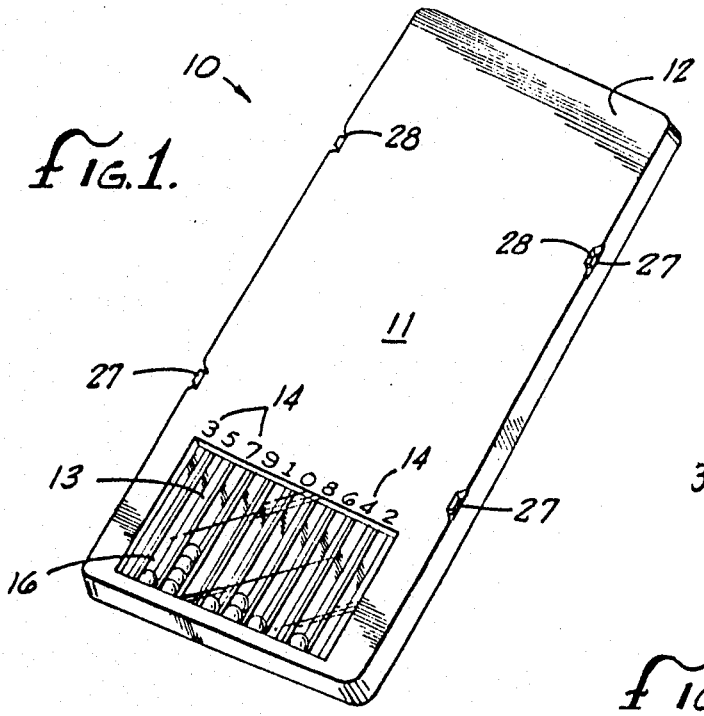
FIG. 1 is a perspective view of the exterior of the game of the present invention.

The game of the present invention is shown in perspective view in FIG. 1 and indicated by reference character 10. Game 10 has a cover 11 which has an opaque portion 12 and a transparent portion 13. A plurality of chambers 15 through 23 are capable of holding one or more balls 25. The number of balls in any chamber is easily counted and may be used in the playing of an amusement game such as liar's poker. Cover 11 is held to tray 26 by four tabs 27 which pass through openings 28 in cover 11.

Figure 4:
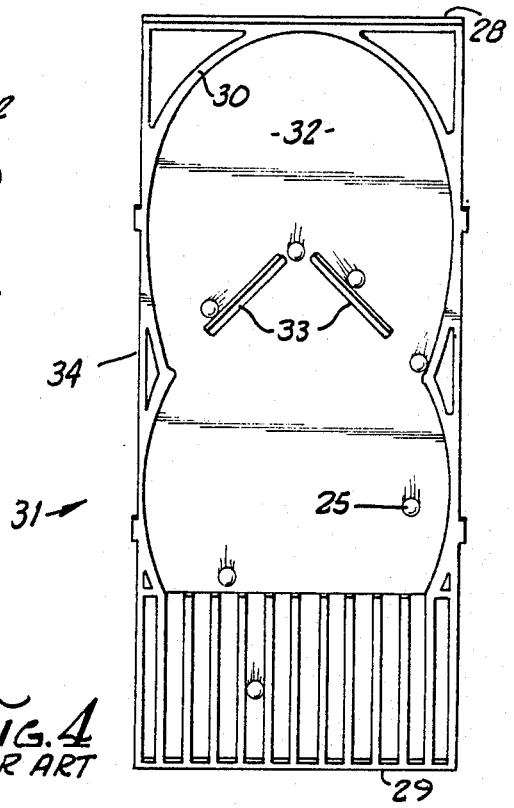
FIG. 4 PRIOR ART
FIG. 4 is a top view of the prior art game.
Figure 2:
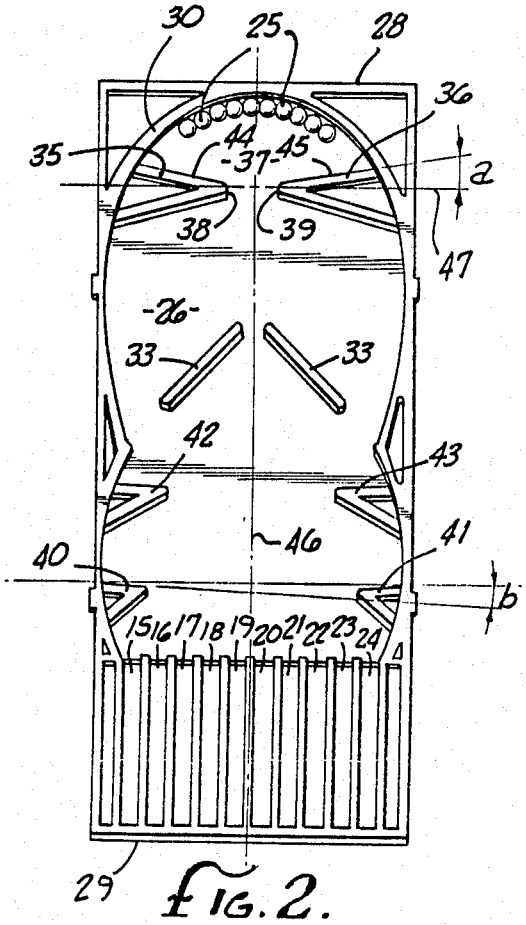
FIG. 2 is a plan view of the game of FIG. 1 with the cover removed and the game being tilted toward the upper edge.
Figure 3:
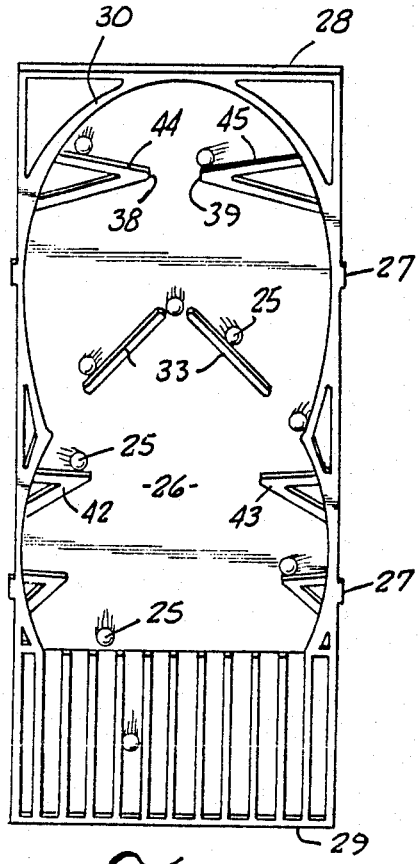
FIG. 3 is a top view of the game of FIG. 1 with the cover removed and the game tilted toward the ball-retaining chambers.

Game 10 is shown in FIG. 2 with cover 11 removed and the game tilted toward the upper end 28. The lower end is indicated by reference character 29. The balls 25 are resting against a ridge 30 which passes around the entire interior of tray 26, and the upper portion of ridge 30 closely abuts the inner surface of cover 11. The interior of a prior art game is shown in FIG. 4 and indicated by reference character 31. Like game 10, game 31 also has a ridge 30 which surrounds the interior of its base 32. A pair of straight baffles 33 are identical to baffles 33 of game 10 and tend to cause most of the balls to move outwardly and strike ridge 30 and be scattered in a relatively random manner in chambers 15 through 24. However, if game 31 is tilted, for instance toward the left side 34, many more balls will fall in chambers 15 and 16 than in, for instance, chambers 23 or 24, thereby giving a predictable result. Although the game can still be played with a non-random distribution of numbers, this feature adds another dimension to the game which makes it unlike the original game which has been popular for many years.

Applicant discovered that by the provision of two large, sideways V-shaped baffles, that a far more random distribution results. As shown in FIG. 2, when the balls are in the chamber area indicated by reference character 37, above baffles 35 and 36, they will not pass between the points 38 and 39 of baffles 35 and 36, respectively, unless the game is tilted in a relatively flat manner. By the term "relatively flat manner," it is intended to indicate that a line along the plane of the upper surface of tray 26, which is perpendicular to the longitudinal axis of tray 26, is approximately horizontal. When the game is tilted in a flat manner, the balls will pass out of chamber 37 and strike, or pass, between baffles 33 and into the various chambers 15 through 24 in a highly random manner. The distance between points 38 and 39 is preferably wide enough to permit two balls to pass between in an abreast manner and narrow enough so that three balls may not pass through abreast.

In a preferred configuration, a pair of small V-shaped baffles 40 and 41 may also be used. This helps prevent the skewing of the game when it is tilted after the balls have left chamber 37. Still further, a second pair of slightly larger sideways V-shaped baffles 42 and 43 may be added to further discourage the tilting of the game. Baffles 42 and 43 tend to hold up the balls when there is any major amount of tilting and also tend to scatter the balls somewhat in a normal tilting action. The result of the six baffles provides a far more random distribution than the prior art game 31.

The upper surface of the baffles 44 and 45, are at a slight angle with respect to a line which is at right angles with the central axis of game 10. The central axis is indicated by reference character 46 and a line perpendicular to this is indicated by reference character 47. The angle between the line which is perpendicular to longitudinal axis 46, namely line 47, and the upper surface of baffle 36 is indicated by the letter "a" and this angle should be between 5° and 15° and preferably about 10°. The angle of the upper surfaces of baffles 40 through 43 should be somewhat less than that of baffles 35 and 36, and it has been found that an angle of between 0° and 10° and preferably of 4° is very satisfactory. This angle is indicated by reference character "b" in FIG. 2.

The space between baffles 42 and 43 is much greater than the space between baffles 35 and 36. The baffles 35 and 36 tend to hold all the balls if the game is tilted in too great a manner, whereas baffles 42 and 43 and baffles 40 and 41 only tend to hold or deflect a small number of balls which would otherwise tend to go in outermost chambers, such as chambers 15 or 24. Although the placement and shape and orientation of the baffles used in the game of the present invention may seem somewhat arbitrary, this is not actually the case. A considerable amount of experimentation revealed that the vast number of baffle placement areas result in an uneven distribution of balls in the chambers.

The game of the present invention provides a relatively low-cost amusement device which is durable and provides a surprisingly unpredictable result in location of the balls. While the term "liar's poker" has been used herein, the device of the present invention may, of course, be used in conjunction with other games since the particular indicia used may be changed to correspond to different games. The game of the present invention is preferably molded from a plastic material and typically has an outside width of two and three-fourth inches, a length of eight and one-half inches and a height of about one-fourth of an inch. The balls useful with the game of such dimensions have an outside diameter of approximately one-eighth of an inch and are preferably metal BBs or other balls of this general shape.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved hand held game for playing liar's poker of the type having a generally flat, hollow, elongated, rectangular tray having an upper end and a lower end with a transparent area located at the lower end exposing to view a plurality of elongated ball-retaining chambers, and the remainder of the tray being covered with an opaque cover, said tray containing a plurality of small balls which fit within the ball-retaining chambers, whereby when the device is tilted so that the ball-retaining chambers are lower than the rest of the tray, the balls roll into one or more of the chambers, the number of balls in each chamber being ascertained by viewing the chambers, wherein the improvement comprises:

a pair of large, generally sideways V-shaped baffles positioned near the upper end of the tray with the points of the baffles facing one another and separated apart a sufficient distance to permit at least two, but not more than four balls, to pass between the points at one time and oriented so that the upper side of the V-shaped baffle causes the balls to pass between the points of the V-shaped baffles when the tray is tilted slightly toward the ball-retaining chambers, whereby when the tray is tilted to the right or left, the balls are held above the generally sideways V-shaped baffles until the tray is moved into a more horizontal orientation so that the balls are more evenly distributed in the chambers than without such sideways V-shaped channels.

2. The improved hand held game for playing liar's poker of claim 1 further including a first pair of small generally V-shaped baffles located within the tray near the ball-retaining chambers to deflect or retain the balls if the tray is tilted after the balls have been released from above the large, generally V-shaped baffles.

3. The improved hand held game for playing liar's poker of claim 2 further including a second pair of small generally V-shaped baffles located above the first pair of small generally V-shaped baffles to further deflect or retain the balls if the tray is tilted after the balls have been released from above the large, generally V-shaped baffles.

4. The improved hand held game for playing liar's poker of claim 3 wherein the second pair of small generally V-shaped baffles is larger than said first pair of small generally V-shaped baffles.

5. An improved hand held game for playing liar's poker of the type having a generally flat, hollow, elongated, rectangular tray having an upper end and a lower end with a transparent area located at the lower end exposing to view a plurality of elongated ball-retaining chambers and the remainder of the tray being covered with an opaque cover and said tray including a pair of straight baffles having their inner ends spaced apart slightly larger than the diameter of one ball and said straight baffles being sloped downwardly from their inner ends and said sloped baffles being located near the middle of the tray between the top of the tray and the top of the chambers, said tray containing a plurality of small balls which fit within the ball-retaining chambers, whereby when the device is tilted so that the ball-retaining chambers are lower than the rest of the tray, the balls roll into one or more of the chambers, the number of balls in each chamber being ascertained by viewing the chambers, wherein the improvement comprises:

a pair of large, generally sideways V-shaped baffles positioned near the upper end of the tray with the points of the baffles facing one another and separated apart a sufficient distance to permit at least two, but not more than four, balls to pass between the points at one time and oriented so that the upper side of the V-shaped baffle causes the balls to pass between the points of the V-shaped baffles when the tray is tilted slightly toward the ball-retaining chambers, whereby when the tray is tilted to the right or left, the balls are held above the generally sideways V-shaped baffles until the tray is moved into a more horizontal orientation so that the balls are more evenly distributed in the chambers than without such sideways V-shaped channels; and a first pair of small generally V-shaped baffles located within the tray near the ball retaining chambers to deflect or retain the balls if the tray is tilted after the balls have been released from above the large generally V-shaped baffles.

6. The improved hand held game for playing liar's poker of claim 5 further including a second pair of small generally V-shaped baffles located above the first pair of small generally V-shaped baffles and below the straight baffles to further deflect or retain the balls if the tray is tilted after the balls have been released from above the large, generally V-shaped baffles.

7. The improved hand held game for playing liar's poker of claim 6 wherein the second pair of small generally V-shaped baffles is larger than said first pair of small generally V-shaped baffles and is located between said second pair of generally V-shaped baffles and the pair of straight baffles.

8. An improved hand held game for playing liar's poker of the type having a generally flat, hollow, elongated, rectangular body having an upper end and a lower end with a transparent area located at the lower end exposing to view a plurality of elongated ball-retaining chambers and the remainder of the body being covered with an opaque cover, said body containing a plurality of small balls which fit within the ball-retaining chambers, whereby when the device is tilted so that the ball-retaining chambers are lower than the rest of the body, the balls roll into one or more of the chambers, the number of balls in each chamber being ascertained by viewing the chambers, wherein the improvement comprises:

a pair of small, generally V-shaped baffles, the first of said pair of generally V-shaped baffles extending from one side of said elongated rectangular body near the ball-retaining chambers, and the second of said pair of generally V-shaped baffles extending from the other side of said elongated rectangular body near the ball-retaining chambers, and the upper surface of said pair of small, generally V-shaped baffles being sloped slightly downwardly with respect to the horizontal so that any balls on the upper surface of either of said small, generally V-shaped baffles will roll off the upper surface when the elongated rectangular body is tilted toward the ball-retaining chambers when a line which is in the plane of the surface of the rectangular body and which line is perpendicular to the vertical bisector of the rectangular body is horizontal and when such line is tilted to any significant amount, one or more balls will be retained on the upper surface of one of said pair of small, generally V-shaped baffles.

9. The improved hand held game for playing liar's poker of claim 8 wherein the upper surface of said pair of small generally V-shaped baffles is sloped at an angle of from about 2° to about 15°.

10. The improved hand held game for playing liar's poker of claim 9 wherein said angle is about 6°.

* * * * *